US007128316B2

(12) United States Patent
Nakano et al.

(10) Patent No.: US 7,128,316 B2
(45) Date of Patent: Oct. 31, 2006

(54) SHEET FEEDING DEVICE

(75) Inventors: Hiroshi Nakano, Nagoya (JP); Takuya Yamaguchi, Toyokawa (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 212 days.

(21) Appl. No.: 10/745,613

(22) Filed: Dec. 29, 2003

(65) Prior Publication Data

US 2004/0169326 A1 Sep. 2, 2004

(30) Foreign Application Priority Data

Dec. 27, 2002 (JP) ..... P2002-379574

(51) Int. Cl.
*B65H 3/52* (2006.01)

(52) U.S. Cl. ..... 271/121; 271/109

(58) Field of Classification Search ..... 271/119, 271/109, 121

See application file for complete search history.

(56) References Cited

U.S. PATENT DOCUMENTS

| | | | | |
|---|---|---|---|---|
| 3,768,803 | A * | 10/1973 | Stange | 271/34 |
| 4,815,724 | A * | 3/1989 | Sumida et al. | 271/121 |
| 5,277,417 | A * | 1/1994 | Moritake et al. | 271/121 |
| 5,370,381 | A * | 12/1994 | Winship et al. | 271/121 |
| 5,584,475 | A | 12/1996 | Asada et al. | |
| 5,727,782 | A * | 3/1998 | Okada | 271/121 |
| 6,082,726 | A * | 7/2000 | Inoue et al. | 271/4.08 |
| 6,126,161 | A * | 10/2000 | Kato | 271/121 |
| 6,585,250 | B1 * | 7/2003 | Hsiao | 271/121 |

FOREIGN PATENT DOCUMENTS

| | | |
|---|---|---|
| JP | A 3-79530 | 4/1991 |
| JP | A 5-58488 | 3/1993 |
| JP | A 5-170347 | 7/1993 |
| JP | A 7-228373 | 8/1995 |
| JP | A 7-261484 | 10/1995 |
| JP | A 7-309465 | 11/1995 |
| JP | A 8-282868 | 10/1996 |
| JP | A 9-315607 | 12/1997 |
| JP | A 10-17171 | 1/1998 |
| JP | A 2000-53265 | 2/2000 |

* cited by examiner

*Primary Examiner*—Eileen D. Lillis
*Assistant Examiner*—Kaitlin Joerger
(74) *Attorney, Agent, or Firm*—Oliff & Berridge, PLC

(57) ABSTRACT

A sheet feeding device includes a sheet feeding roller and a holder body. A separation pad is arranged on an upstream side, in a feeding direction of a recording medium, within a concave portion of a top surface side of the holder body facing a surface of the sheet feeding roller. On a downstream side of the concave portion adjacent to the separation pad, a low friction member is arranged in which at least a surface layer is formed of a material with a small coefficient of friction. Furthermore, a gap formation portion is formed in a surface of the concave portion where the low friction member is arranged and made higher than a surface where the separation pad is arranged. Additionally, by making the separation pad and the low friction member with the same thickness, when arranged in the concave portion, the surface of the low friction member is formed higher than the surface of the separation pad by the height of the gap formation portion.

8 Claims, 13 Drawing Sheets

SHEET FEEDING DEVICE

BACKGROUND OF THE INVENTION

1. Field of Invention

This invention relates to a sheet feeding device that separates and supplies recording media stacked in a sheet feeding portion, one by one, from the uppermost position in an image forming apparatus such as a laser beam printer, a copier, a facsimile device, or the like.

2. Description of Related Art

In a sheet feeding device disclosed in U.S. Pat. No. 5,584,475, an uppermost sheet of paper, among sheets of paper stacked and stored in a sheet feeding cassette, is sandwiched between a sheet feeding roller and a separation pad to separate the sheet from the stack and send the sheet forward in a sheet feeding direction. However, in a conventional sheet feeding device, such as that disclosed above, when a sheet of paper is sandwiched between a sheet feeding roller and a separation pad and sent forward, a paper feeding noise is usually generated. Therefore, in order to reduce the noise, U.S. Pat. No. 5,584,475 discloses a noise erasing portion formed of a material, with a small coefficient of friction, arranged downstream of a surface of the separation pad in a sheet feeding direction.

SUMMARY OF THE INVENTION

The object of this invention is to provide a sheet feeding device to stabilize feeding of recording media and reduce noise created by the sheet feeding roller and separation pad during the sheet feed operation.

According to a first exemplary aspect of the invention, a sheet feeding device is provided with a sheet feeding roller that feeds recording media stacked in a sheet feeding portion, a separation pad that presses the recording media toward the surface of the sheet feeding roller, and a low friction member that includes at least a surface layer formed of a material with a coefficient of friction smaller than that of the separation pad, is arranged so that the surface of the sheet feeding roller is placed over the separation pad and the low frictional member, and is arranged so that the surface of the low friction member is positioned closer to the roller than the surface of the separation pad to form a gap.

By forming a gap between the sheet feeding roller and the separation pad so that the low friction member side is higher toward the sheet feeding roller side, the recording media does not easily contact the separation pad that creates frictional resistance, and sheet feeding noise generation can be further controlled. Therefore, when the recording media sandwiched between the surface of the sheet feeding roller and the separation pad is separated and reaches the low friction member, the frictional resistance created between the sheet feeding roller, separation pad and the recording media is reduced to allow the recording media to be fed smoothly between the separation pad and the surface of the sheet feeding roller. Therefore, paper feeding noise, and/or the like, created by the recording media feeding operation discussed above, can be controlled.

According to another exemplary aspect of the invention, a sheet feeding device is provided with a roller that contacts and feeds recording media stacked in a sheet feeding portion; and a separation pad, having a surface layer with a coefficient of friction, that is pressed toward a surface of the roller, wherein, in the vicinity of the center of the separation pad in a feeding direction of the recording media, a convex portion is formed having a surface positioned closer to the roller than other portions of the surface layer.

According to this structure, friction separates the recording media by the rotating sheet feeding roller and the separation pad presses the recording media toward the surface of the sheet feeding roller. Thus, even if recording media is fed to the sheet feeding roller side from the sheet feeding portion in a state in which a plurality of sheets of the recording media are stacked, the recording media, other than the recording media that is originally fed, are separated as the leading edge of the recording media contacts the convex portion. Thus, feeding of only one sheet of the recording media can be performed without reaching the contact point of the sheet feeding roller and the separation pad.

According to yet another exemplary aspect of the invention, a sheet feeding device is provided with a sheet feeding portion that stacks recording media, a roller that contacts and feeds the recording media, a pressing member that is arranged relative to the roller and is pressed toward the roller, and a holder body, having an arrangement surface that arranges the pressing member, and a gap portion with a predetermined height is formed in a predetermined region of the arrangement surface.

According to this structure, friction separates the recording media by the rotating sheet feeding roller and the separation pad presses the recording media toward the surface of the sheet feeding roller. Thus, if the height difference is formed between the predetermined region of the arrangement surface of the holder body and the other regions of the arrangement surface, when a pressing member is arranged, an arbitrary region of the surface of the pressing member can be formed higher than other regions of the pressing member according to the height difference of the arrangement surface.

These and other features and advantages of the invention are described in or are apparent from the following detailed description of the systems and methods according to this invention.

BRIEF DESCRIPTION OF THE DRAWINGS

Various exemplary embodiments of this invention will be described in detail, with reference to the following figures, wherein:

FIG. 5(*b*) is an enlarged view of the characteristic portions of FIG. 5(*a*);

FIG. 8(*b*) is an enlarged sectional view of a main portion of FIG. 8(*a*);

FIG. 9(*b*) is an enlarged sectional view of a main portion of FIG. 9(*a*);

FIG. 13(*b*) is an enlarged sectional view of a main portion of FIG. 13(*a*);

FIG. 14(*b*) is a an enlarged sectional view of a main portion of FIG. 14(*a*);

FIG. 15(*b*) is a perspective view of the separation pad and the support piece of FIG. 15(*a*).

DETAILED DESCRIPTION OF EXEMPLARY EMBODIMENTS

Embodiments of the invention are explained with reference to the accompanying drawings.

Figure 1:
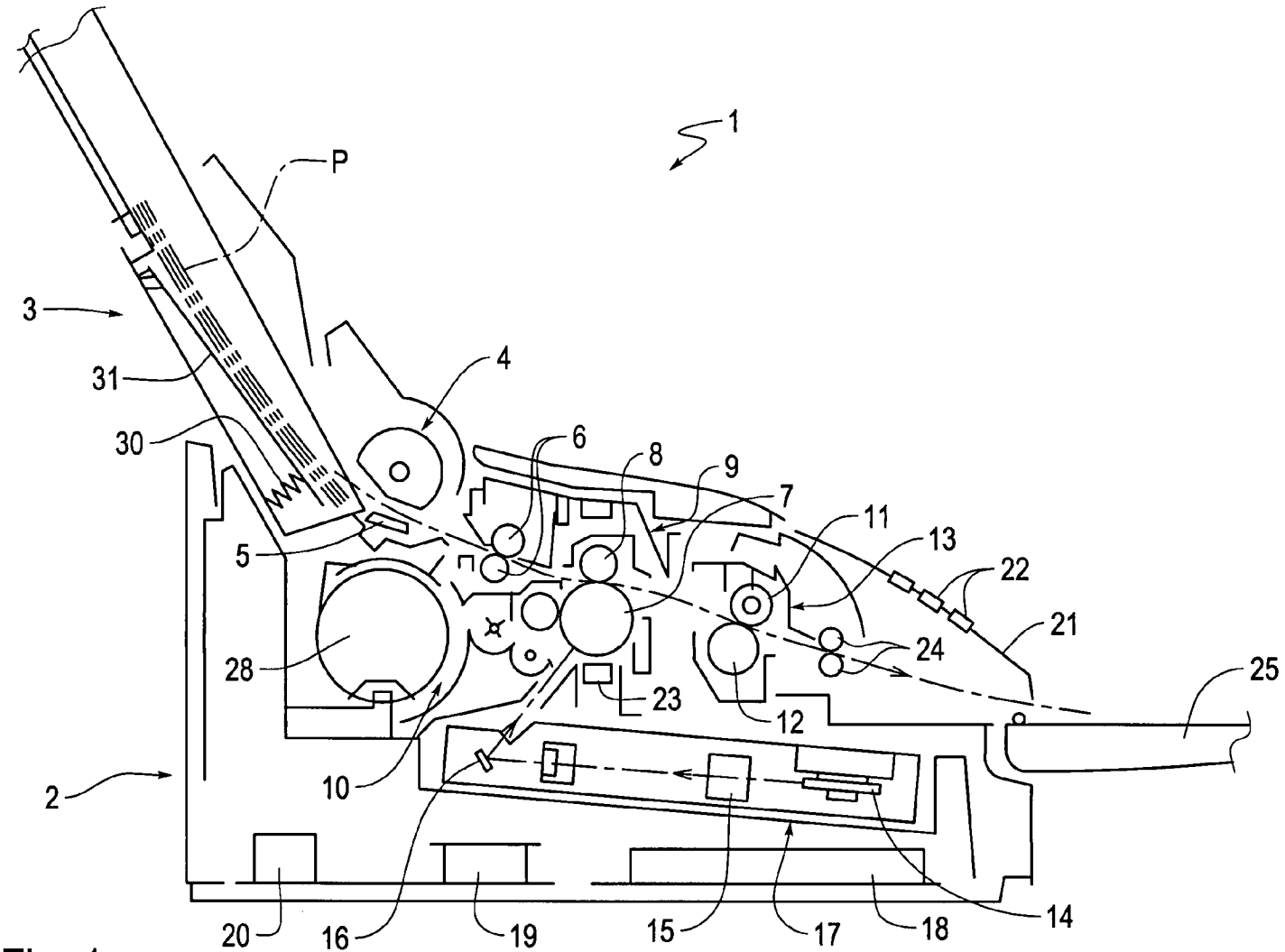
FIG. 1 is a schematic side sectional view of a laser printer.
Figure 2:
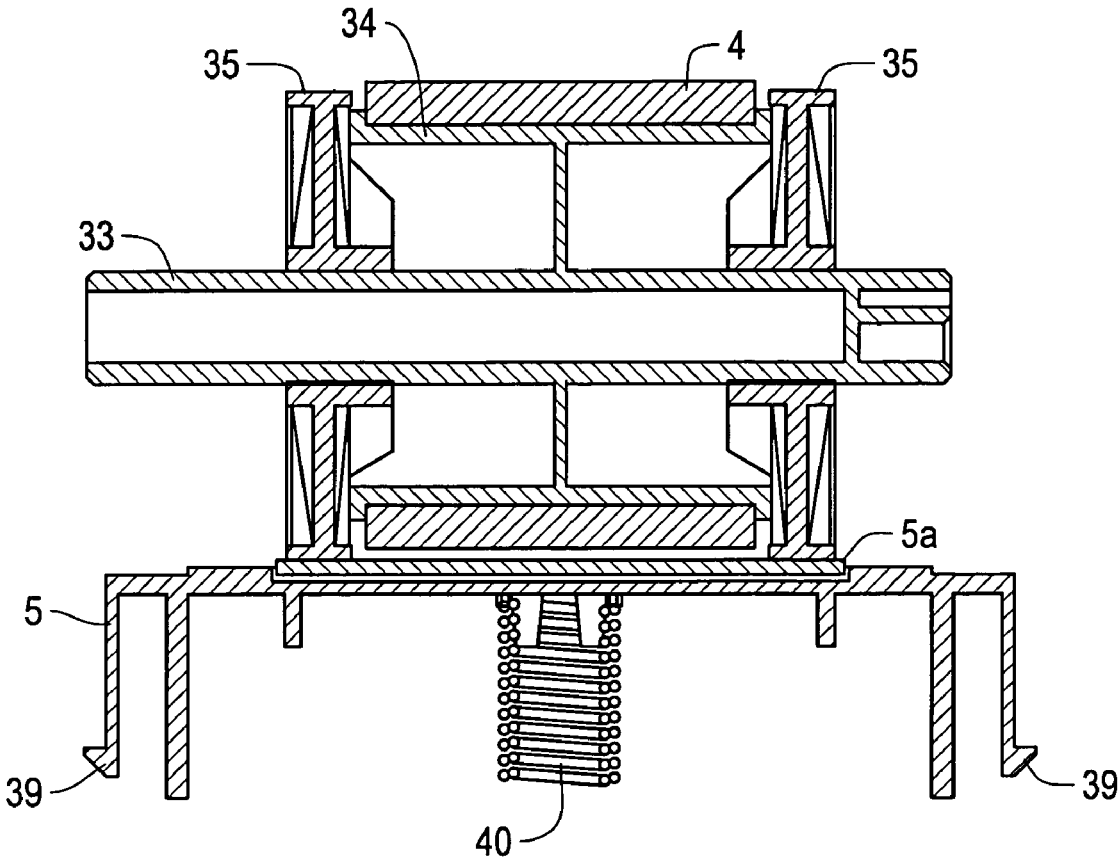
FIG. 2 is a partial front view of a sheet feeding device provided in the laser printer of FIG. 1.

FIG. 1 shows a schematic sectional view of a printer 1, and FIG. 2 shows a main portion side cross-sectional view of a sheet feeding device.

As shown in FIGS. 1 and 2, the printer 1 includes a sheet feeding cassette 3 that can be detachably mounted on one upper side of a main body case 2. By a sheet feeding roller 4 and a separation pad 5*a*, sheets of paper P stacked within the sheet feeding cassette 3 are separated, one by one, and are transferred to a photosensitive body unit 9 that includes a transfer roller 8 and a photosensitive body drum 7 via a pair of transfer rollers 6. On the side of the photosensitive body unit 9 closer to the sheet feeding cassette 3 and adjacent to the photosensitive body unit 9, a developing device 10 is arranged to supply toner fed from a toner cartridge 28 to the photosensitive body drum 7. A fixing unit 13 including a heat roller 11 and a pressing roller 12 are arranged on the a side of the photosensitive body unit 9 opposite from the developing device 10.

Under the photosensitive body unit 9, a scanner unit 17 including a laser emitting portion 14, a lens 15, and a reflective mirror 16, control substrates 18, 19, and a power source unit 20 are arranged. In a cover body 21 covering the entire printer 1, a plurality of operation buttons 22 are arranged.

On the surface of the photosensitive body drum 7 that has been pre-charged by a charger 23, in accordance with image data transmitted from a computer (not shown), an electrostatic latent image is formed on the surface of photosensitive body drum 7 when light emitted from the scanner unit 17 is irradiated.

Next, a toner image is formed by changing the latent image of the photosensitive body drum 7 to a visible image by particles of toner supplied from the developing device 10, and the toner image is transferred to the paper P supplied between the photosensitive body drum 7 and the transfer roller 8.

Then, in the fixing unit 13, heat and pressure are applied to the toner image transferred to the paper P, the toner image is fixed to the paper P, and the paper P is ejected from a paper ejecting roller 24 to a paper ejecting tray 25.

Operation of the sheet feeding device is discussed in greater detail below.

Figure 3:
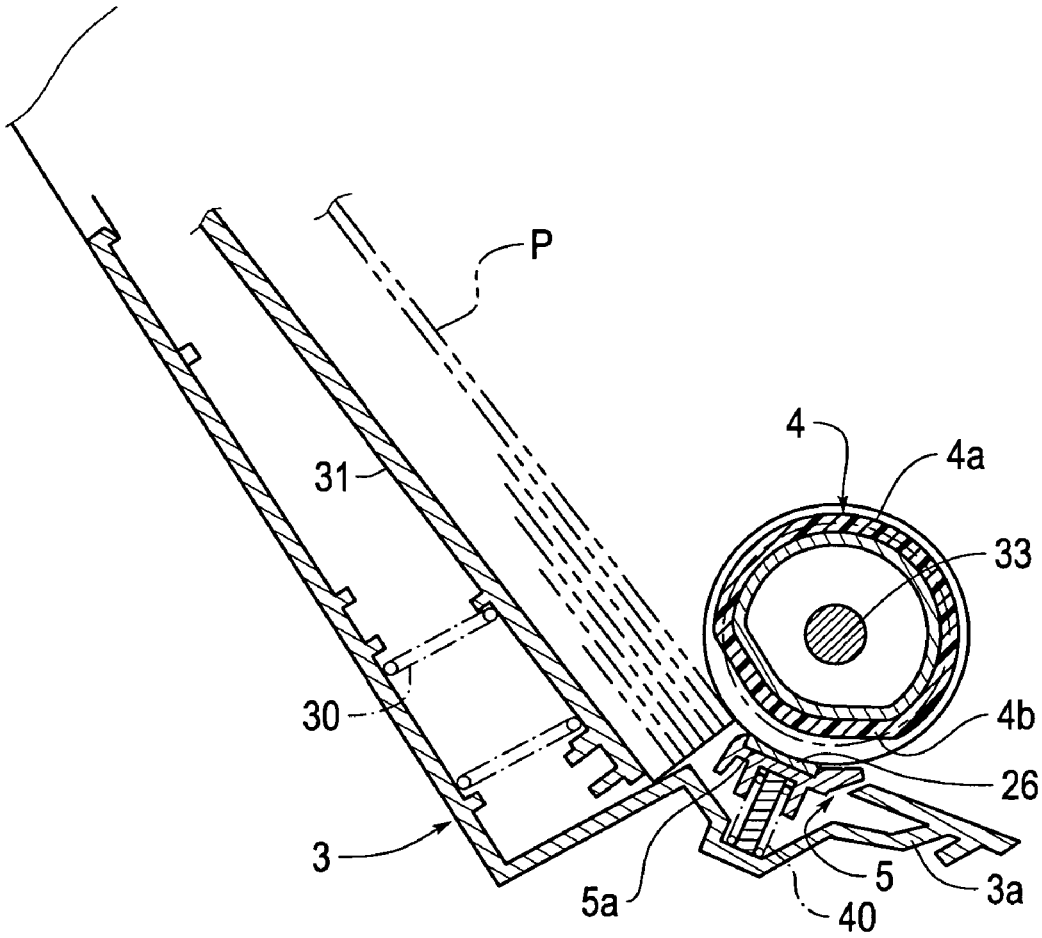
FIG. 3 is a side sectional view of a sheet feeding device provided in the laser printer of FIG. 1.

Within the sheet feeding cassette 3 of the paper feeding device, as shown in FIG. 3, a sheet receiving plate 31 is urged upward by a spring 30 arranged in contact with the lower surface side of the sheet feeding roller 4. Among a plurality of sheets of paper P stacked on the sheet receiving plate 31, the top surface of the lower end side of the paper P at the uppermost position contacts the surface of the sheet feeding roller 4. A holder body 5 that supports the separation pad 5*a* and a low friction member 26 is fixed to a lower end portion 3*a* of the sheet feeding cassette 3. The separation pad 5*a* contacts the surface of the sheet feeding roller 4. Under the holder body 5, a spring 40 is arranged between the lower end portion 3*a* of the sheet feeding cassette 3 and the holder body 5, and the holder body 5 is pressed toward the sheet feeding roller 4.

As shown in FIG. 2, the sheet feeding roller 4 is arranged so as to contact the periphery of a composite resin cylindrical body 34 that is rotated together with a driving shaft 33. An outer peripheral surface of the sheet feeding roller 4 is formed substantially in a D-shape, as shown in the side cross-section view of FIG. 3, having a circular peripheral surface shaped contact surface 4*a* that contacts the paper P and a non-contact surface 4*b* that does not contact the paper P. At least the contact surface 4*a* is constituted by a material with a large coefficient of friction such as rubber and/or the like. The driving shaft 33 is intermittingly rotated via a driving motor and a transmission gear mechanism (not shown).

On the both end sides of the sheet feeding roller 4, composite resin cylindrical sheet feeding collars 35, 35 are freely engaged on the driving shaft 33. The internal diameter of the sheet feeding collars 35 is slightly larger than the outer diameter of the driving shaft 33, so the sheet feeding collars 35 freely rotate around the driving shaft 33.

The radius of the outer circumference of the sheet feeding collars 35 is set to be slightly smaller than the radius of the outer circumference of the contact surface 4*a* of the sheet feeding roller 4. The following explains the degree of the radius of the outer circumference. In the case of a rotation phase in which the non-contact surface 4*b* of the sheet feeding roller 4 faces the paper P, the sheet feeding collars 35 are pressed against the surfaces of both the separation pad 5*a* and the low friction member 26, and are pressed against the surface of the paper P positioned thereon. In the case of a rotation phase in which the contact surface 4*a* faces the paper P, the peripheral surface of the sheet feeding collars 35 contact the surface of the paper P.

The holder body 5 is mounted by engagement of claws 39, 39, arranged on both the right and left sides of the holder body 5, as shown in FIG. 2, with grooves (not shown) arranged in the lower end portion 3*a* of the sheet feeding cassette 3.

Figure 4:
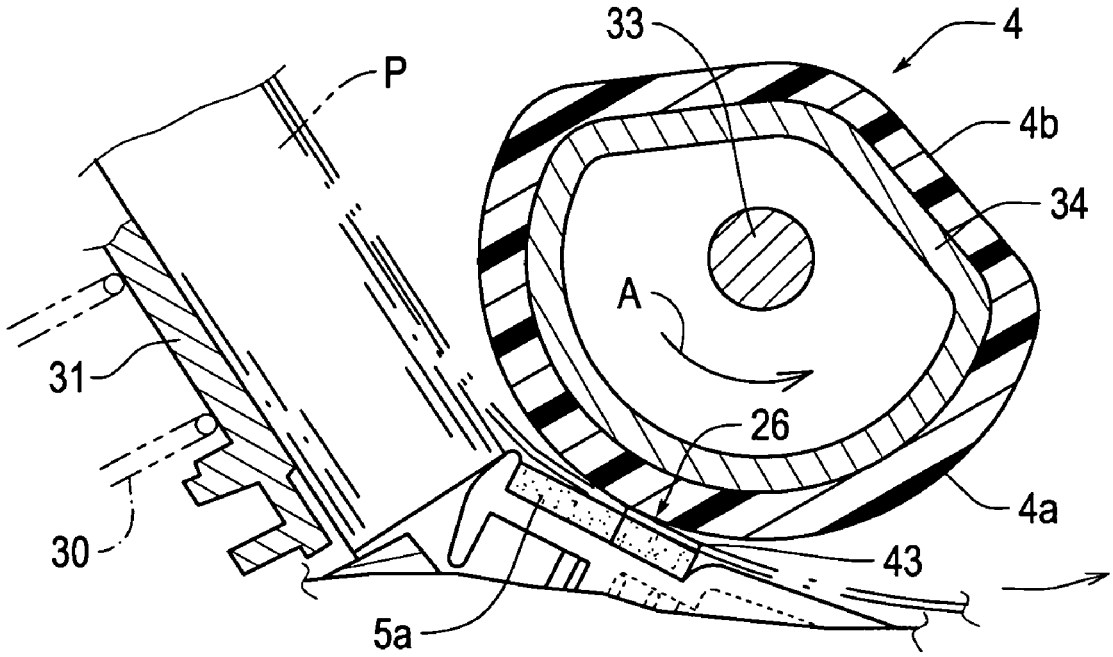
FIG. 4 is a partial side sectional view showing the sheet feeding device of FIG. 3 when a contact surface of a sheet feeding roller faces a recording medium.

As shown in FIG. 4, on the surface of the holder body 5, on the upstream side in the paper feeding direction, a separation pad 5*a* that is formed by a urethane foam resin material with a large coefficient of friction is arranged. On the downstream side in the feeding direction of the paper P, the low friction member 26 is fixed adjacent to the separation pad 5*a*. The fixed low friction member 26 includes a film 43 having at least a surface layer formed of a material such as ultra polymer polyethylene with a small coefficient of friction.

A method of fixing the film 43 of the low friction member is discussed in greater detail below.

Figure 5A:
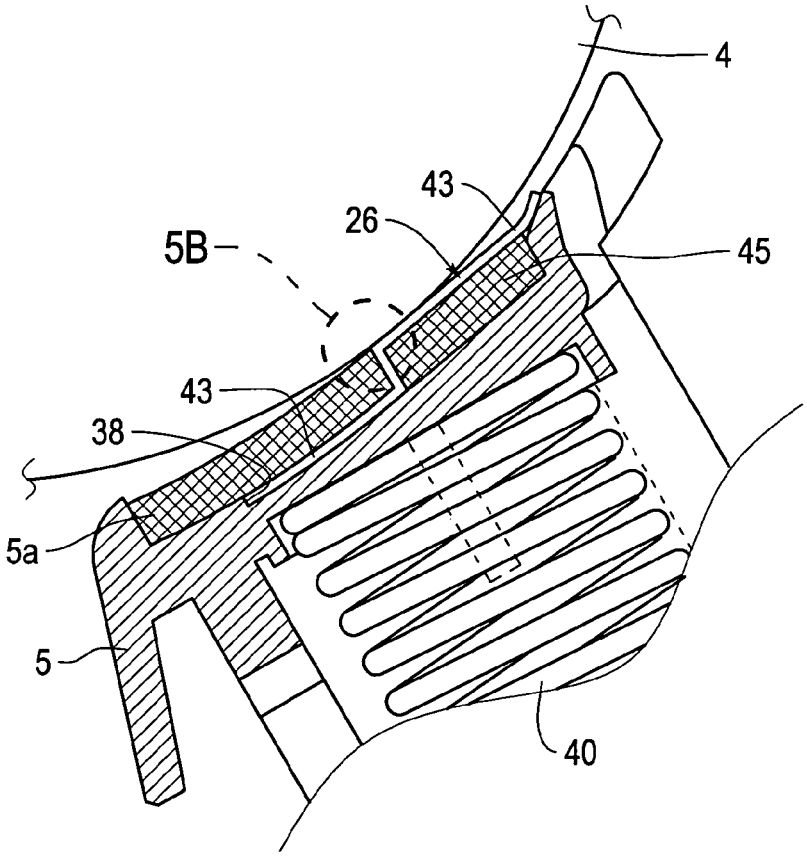
FIG. 5(*a*) is a partial side sectional view of characteristic portions of the sheet feeding device of FIG. 2 according to a first exemplary embodiment.
Figure 5B:
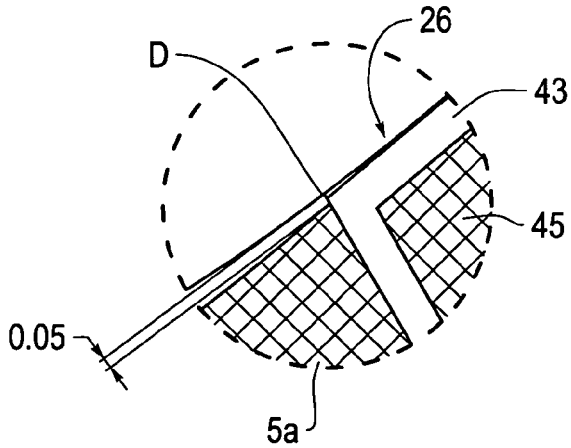

As shown in FIG. 5(*a*), on the surface side of the holder body 5, on the upstream side in the feeding direction of the paper P, a concave portion 38 corresponding to the arrangement surface of the holder member 5 is formed longer in a direction perpendicular to the feeding direction of the paper P. At the bottom surface of the concave portion 38, a front portion of the film 43 having a thickness of approximately 0.1 mm is attached and fixed via a double-sided adhesive tape. On the top surface of the film 43, the separation pad 5*a* is attached and fixed via a double-sided adhesive tape.

The film 43 is folded along the back side surface, the downstream side surface, of the separation pad 5*a*. On the bottom back side (the downstream side in the feeding direction of the paper P) of the concave portion 38, a support piece 45 with the same thickness and material as the separation pad 5*a* is attached and fixed via a double-sided adhesive tape. To the support piece 45, a rear portion of the film 43 is attached and fixed via a double-sided adhesive tape. Although the film 43 is described as attached and fixed via a double-sided adhesive, the film 43 can be attached and fixed by any fastening means such as, for example, a fastening member, adhesive and/or the like.

A first exemplary embodiment of the holder body 5 is discussed in greater detail below.

Figure 6:
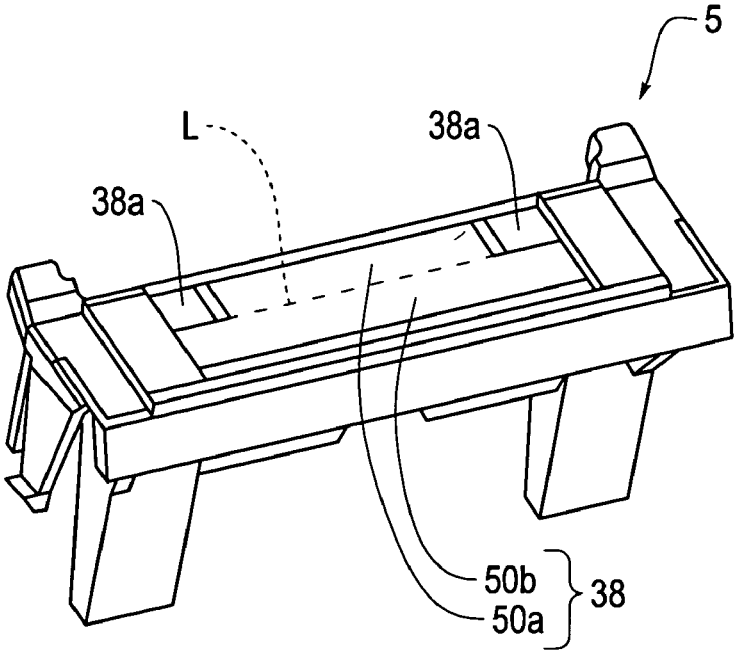
FIG. 6 is a perspective view of a holder body in the first exemplary embodiment.

FIG. 6 shows a perspective view of the holder body 5. As shown in FIG. 6, the low friction member 26 is arranged in a region 50*a* divided by dotted lines L in the concave portion 38, and the separation pad 5*a* is arranged in a region 50*b*. The region 50*b* is positioned on the upstream side, in the feeding direction of the paper P, with respect to the region 50*a*.

Figure 7:
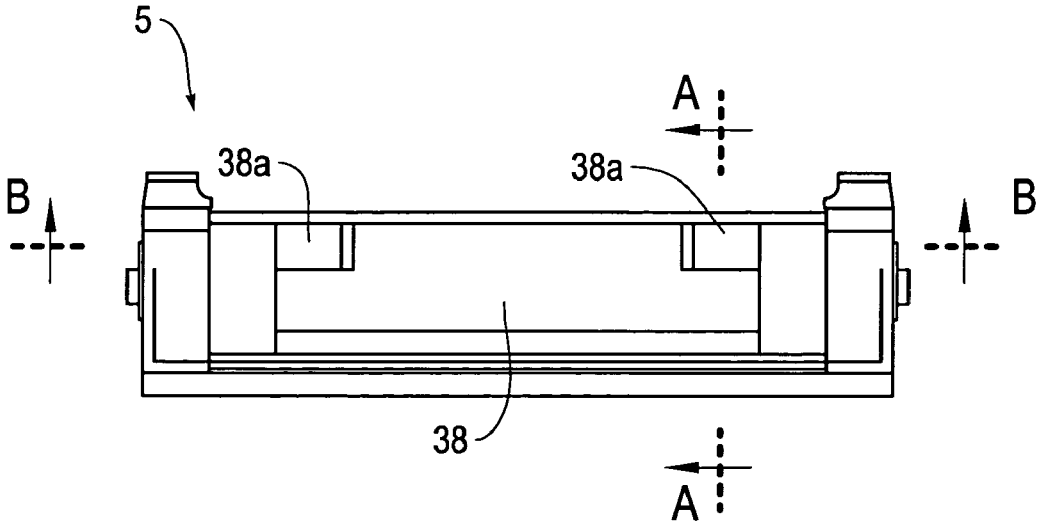
FIG. 7 is a top view of the holder body of FIG. 6.

FIG. 7 shows a top view of the holder body 5. As shown in FIG. 7, on both ends in the longitudinal direction of the region 50*a*, gap portions 38*a* are arranged at a position higher than the region 50*a*. The gap portions 38*a* are respectively arranged at a position that can contact the outer periphery of the sheet feeding collars 35.

Figure 8A:
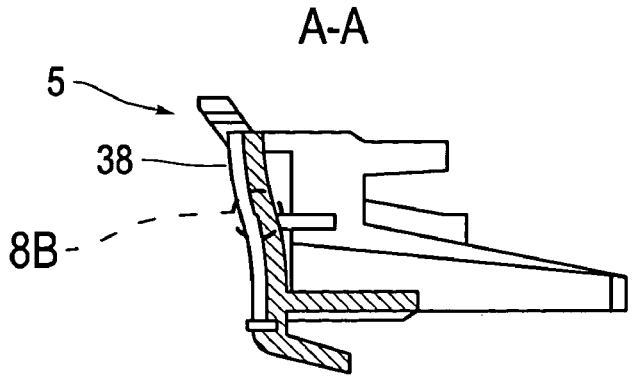
FIG. 8(*a*) is a cross-sectional view of the holder body of FIG. 7 taken at line A—A.
Figure 8B:
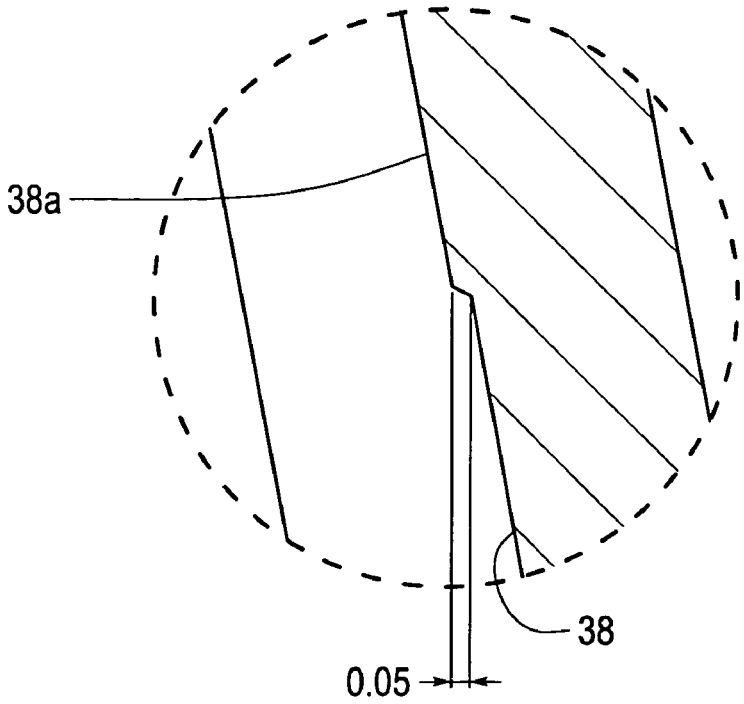

FIG. 8(*a*) shows a cross-sectional view of the holder body 5 taken at line A-A of FIG. 7 including the gap portions 38*a*. FIG. 8(*b*) shows an enlarged view in the vicinity of the boundary of the gap portions 38*a* and the concave portion 38 of FIG. 8(*a*). As shown in FIG. 8(*b*), the gap portion 38*a* has a height of approximately 50 μm (0.05 mm) with respect to the bottom surface of the concave portion 38.

Figure 9A:
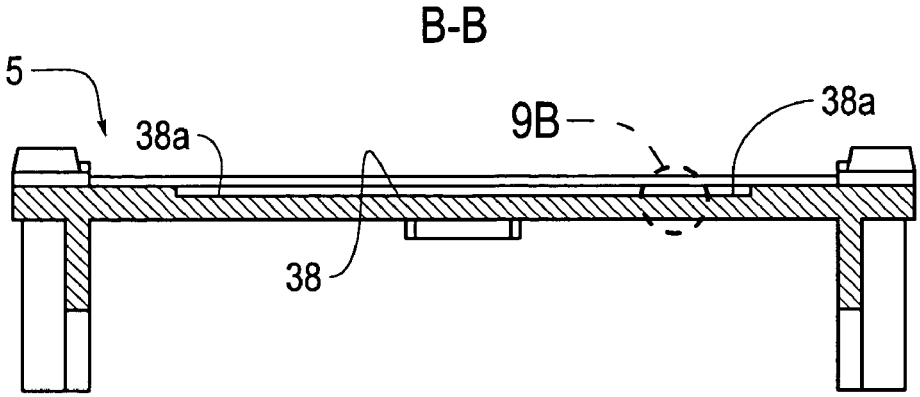
FIG. 9(*a*) is a cross-sectional view of the holder body of FIG. 7 taken at line B—B.
Figure 9B:
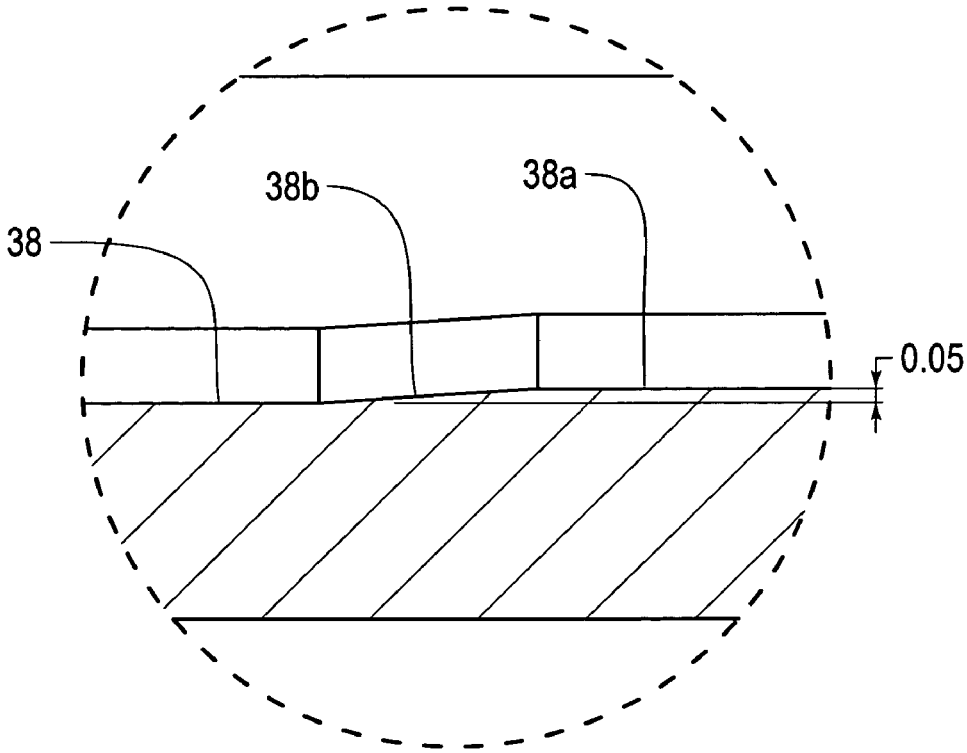

FIG. 9(*a*) shows a cross-sectional view of the holder body 5 taken at line B-B of FIG. 7 including the gap portions 38*a*. FIG. 9(*b*) shows an enlarged view in the vicinity of the boundary of the concave portion 38 and the gap portions 38*a* of FIG. 9(*a*). As shown in FIG. 9(*b*), an inclined surface 38*b* is provided that is inclined toward the top surface of the gap portions 38*a* from the bottom surface of the concave portion 38.

The separation pad 5*a* is arranged in the region 50*b* of the concave portion 38 of the holder body 5, and the support piece 45 is arranged in the region 50*a*. The separation pad 5*a* and the support piece 45 are formed with the same thickness and material, and the film 43 is fixed under the separation pad 5*a* also forms the low friction member 26.

Therefore, as shown in FIG. 5(*b*), between a top surface of the low friction member 26 and a top surface of the separation pad 5*a*, a gap D is formed so that the surface of the low friction member 26 becomes higher than the surface of the separation pad 5*a* by the height of each of the gap portions 38*a* measured from the bottom surface of the concave portion towards the sheet feeding roller 4. Furthermore, by providing the inclined surface 38*b* inclined towards the gap portions 38*a*, when the separation pad 5*a* is mounted, the separation pad 5*a* contacts the bottom surface of the concave portion 38. That is, the separation pad 5*a* is reduced from floating up from the bottom surface of the concave portion 38.

When the height of the gap D is about 75 μm or less, a value smaller than the thickness of the thinnest sheet of paper P that can be used in the printer 1, a good result is obtained for reduction of both noise generation and double-paper feeding. Since noise is generated when the separation pad 5*a* contacts the paper P, making the low friction member 26 side higher toward the sheet feeding roller 4 side than the separation pad 5*a* keeps the paper P from easily contacting the separation pad 5*a*. Therefore, when the paper P reaches the low friction member 26, instead of the separation pad 5*a*, noise generation can be controlled.

If only the noise reduction is considered, when the height of the gap D exceeds 75 μm, a better noise reduction result is obtained. However, as a height of the gap D becomes higher, there is a problem that a lead edge of the paper P to be fed contacts the gap D and double-paper feeding is easily generated.

If a height of the gap D is made smaller, the problem of double-paper feeding is reduced, but the effect of noise reduction becomes harder to obtain. It was discovered that, to obtain a desirable level of noise reduction, the height of the gap D should be at least about 25 μm.

Therefore, the height of the gap portion 38*a*, shown by the gap D, within a range of 25 μm–75 μm is effective in reduction of both noise generation and double-paper feeding. If the height of the gap D is not within the above-mentioned range, there is a possibility that problems in noise generation or double-paper feeding may exist.

Although, in this exemplary embodiment, the gap formation portions 38*a* are arranged in the longitudinal direction on both ends in the region 50*a* of the concave portion 38 of the holder body 5, they can also be formed so that the entire region 50*a* becomes higher than the region 50*b* by the height of the gap D.

A sheet feeding operation by the above-mentioned sheet feeding device is discussed in greater detail below.

Before a sheet of the paper P is fed, as shown in FIGS. 2–5(*a*), the lower surface of the outer diameter of the sheet feeding collar 35 on the driving shaft 33 contacts the surface of the film 43 and the separation pad 5*a* on the surface of the holder body 5, and the non-contact surface 4*b* of the sheet feeding roller 4 faces the separation pad 5*a* and the film 43.

When printing instructions given from the control substrates 18, 19 are input to the printer 1, a driving motor (not shown) is operated, the driving shaft 33 is rotated, and the sheet feeding roller 4 is rotated in the direction of arrow A shown in FIG. 4. Because of this rotation, when the contact surface 4*a* of the sheet feeding roller 4 begins to contact the separation pad 5*a*, the leading edge of the sheet of paper P at the uppermost position stacked in the sheet feeding cassette 3 is inserted between the contact surface 4*a* and the separation pad 5*a*.

When the leading edge of the paper P reaches the surface of the film 43, the surface of the film 43 has a coefficient of friction smaller than that of the contact surface 4*a*, so the paper P is easily fed by smoothly contacting the film 43. At this time, the film 43 is at a position higher than the separation pad 5*a* by the height of the gap D, so the paper P contacts the film 43 only and does not easily contact the separation pad 5*a* to reduce the noise generated at the time of the paper feeding.

Furthermore, as mentioned above, the surface of the film 43 is formed higher than the surface of the separation pad 5*a* by the height of the appropriate gap D, so the reduction of both noise generation and double-paper feeding can be performed.

When the sheet feeding roller 4 is rotated once, the non-contact surface 4*b* again returns to a location facing the separation pad 5*a* and the film 43, and stops rotating.

A second embodiment of the holder body 5 is discussed in greater detail below.

Figure 10:
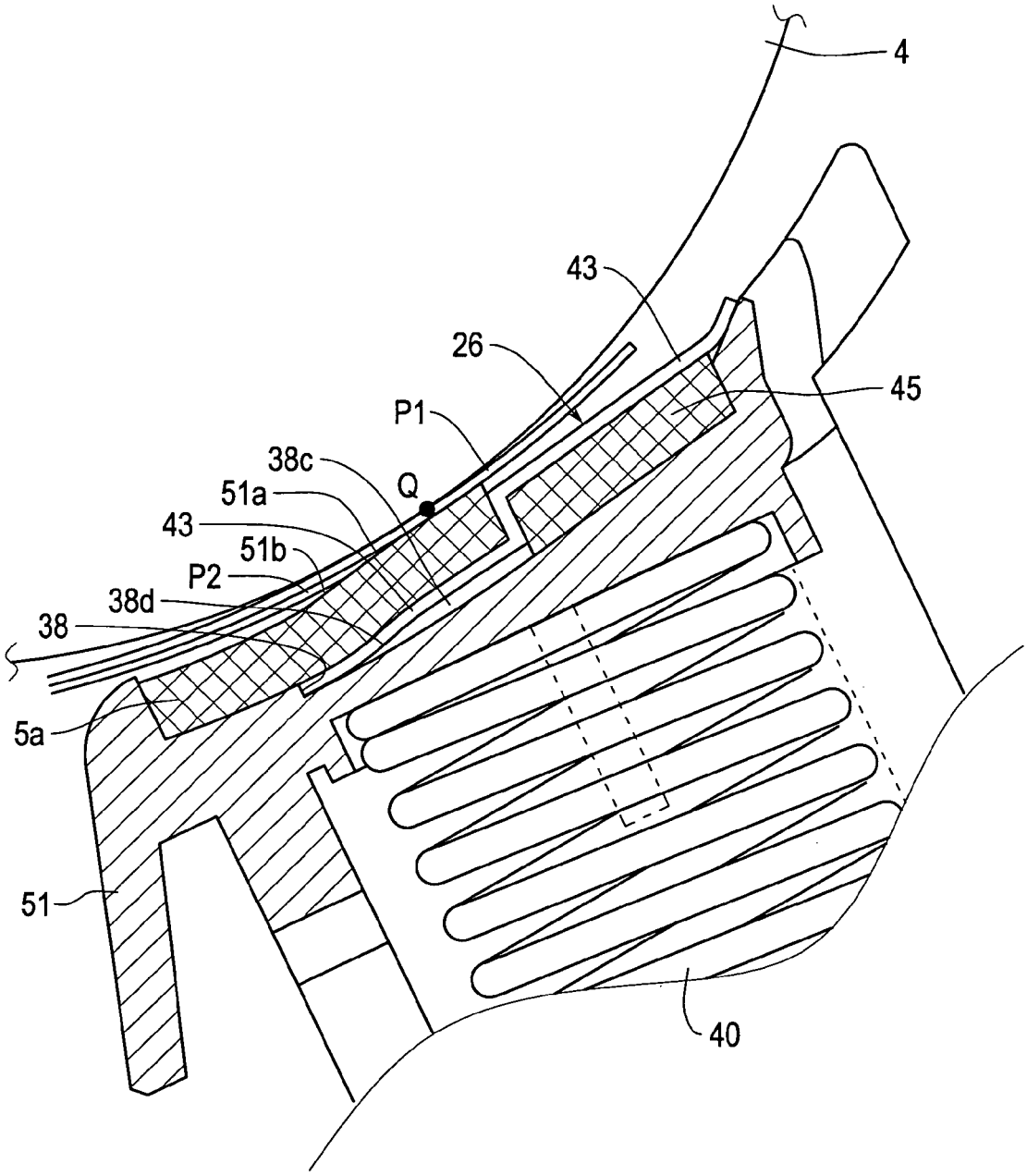
FIG. 10 is a partial side sectional view of characteristic portions of a sheet feeding device provided in the laser printer of FIG. 1 according to a second exemplary embodiment.

FIG. 10 shows an enlarged view of a characteristic portion of the holder body according to a second exemplary embodiment. As shown in FIG. 10, on the top surface of the separation pad 5*a*, a convex portion 51*a* is formed which is made gradually higher in the sheet feeding direction approaching the low friction member 26.

The holder body 51 in the second exemplary embodiment is discussed in detail below.

Figure 11:
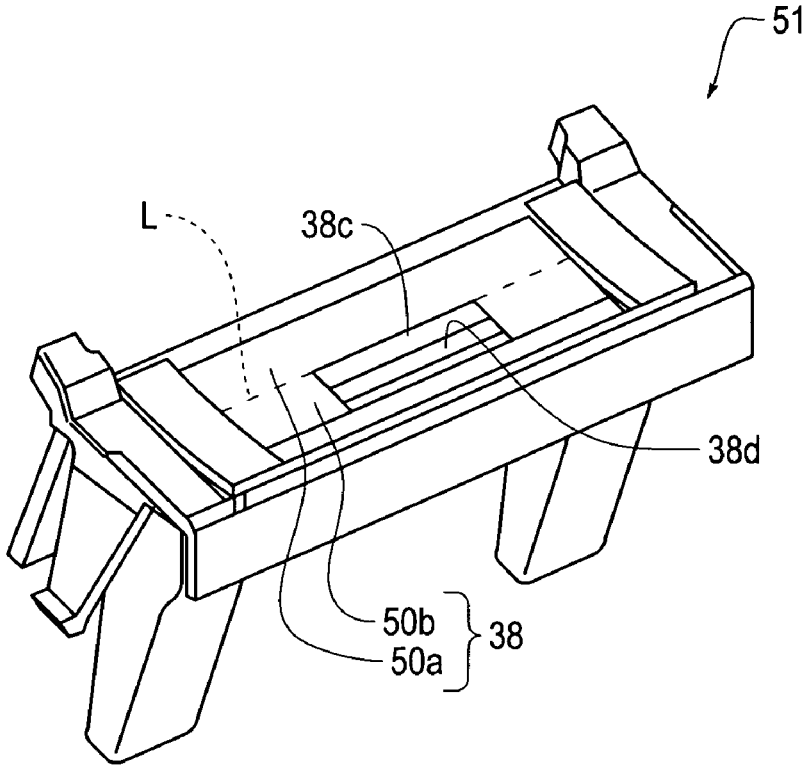
FIG. 11 is a perspective view of a holder body in the second exemplary embodiment.
Figure 12:
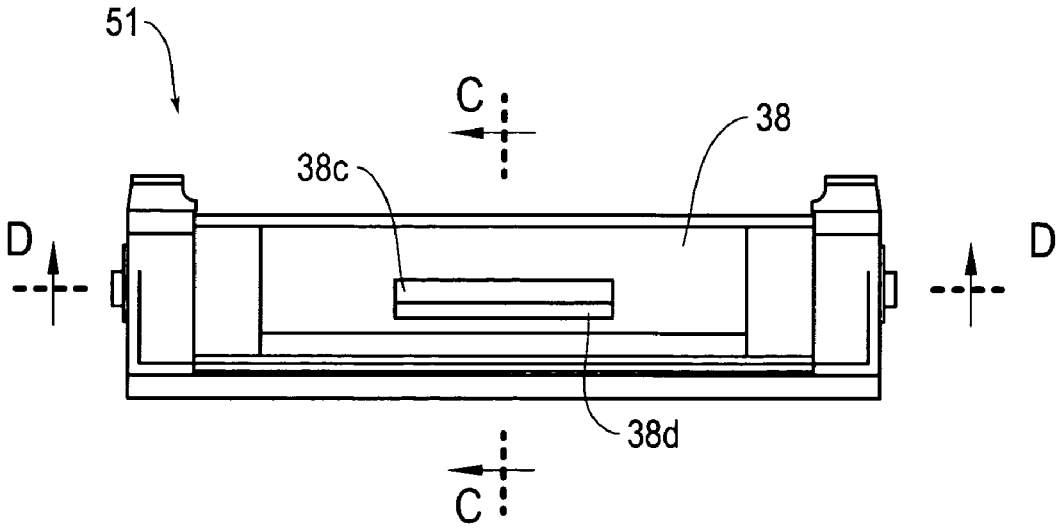
FIG. 12 is a top view of the holder body of FIG. 11.

FIG. 11 is a perspective view of the holder body 51 and FIG. 12 is a top view of the holder body 51. The structure of the holder body 51 is substantially the same as the holder body 5 described in the first exemplary embodiment. The same reference numerals are used for the same members, and thus, a detailed description thereof is omitted.

In FIGS. 11 and 12, the separation pad 5*a* is arranged in a region 50*b* divided by a dotted line L that passes through the middle of the concave portion 38. The lower friction member 26 is arranged in the region 50*a*. Furthermore, a convex portion 38*c* is arranged in the region 50*b* next to the longitudinal center that passes between the region 50*a* and the region 50*b*.

Figure 13A:
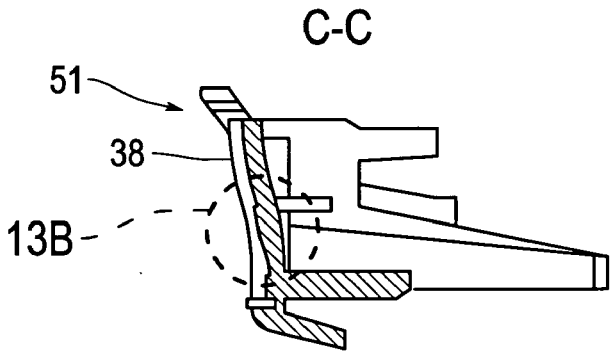
FIG. 13(*a*) is a cross-sectional view of the holder body of FIG. 12 taken at line C—C.
Figure 13B:
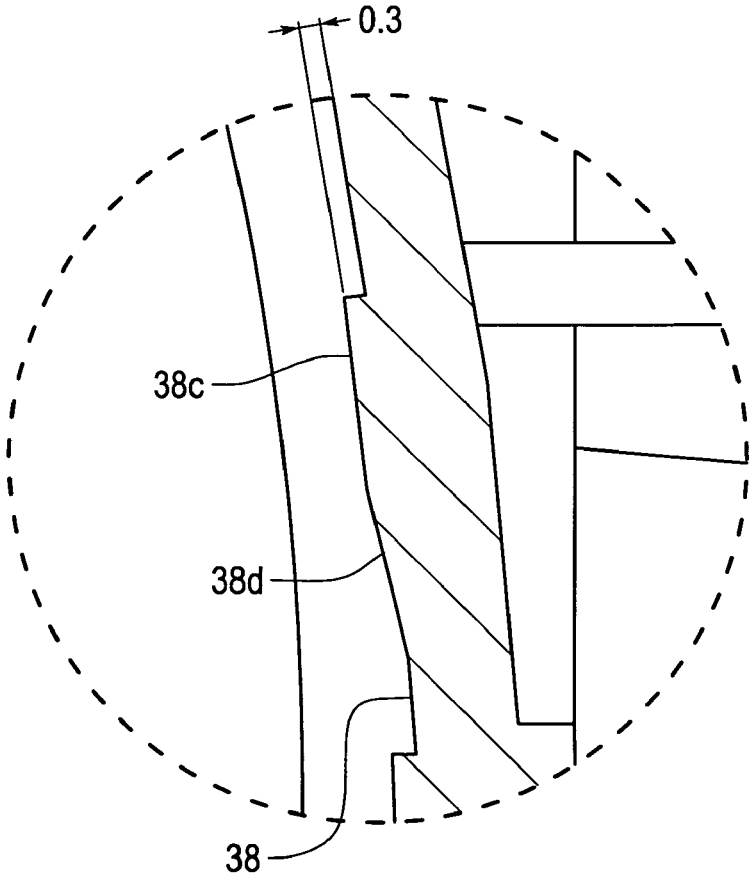

FIG. 13(*a*) shows a cross-sectional view of the holder body 51 at line C—C of FIG. 12 including the convex portion 38*c*. FIG. 13(*b*) shows an enlarged view of the surrounding area of the convex portion 38*c* of FIG. 13(*a*). As shown in FIG. 13(*b*), an inclined surface 38*d* is inclined toward the apex of the convex portion 38*c* from the bottom surface of the concave portion 38. The inclined surface 38*d* is formed only on the upstream side in the sheet feeding direction of the convex portion 38*c*, and a gap is formed on the downstream side in the sheet feeding direction. The gap height is approximately 0.3 mm.

Figure 14A:
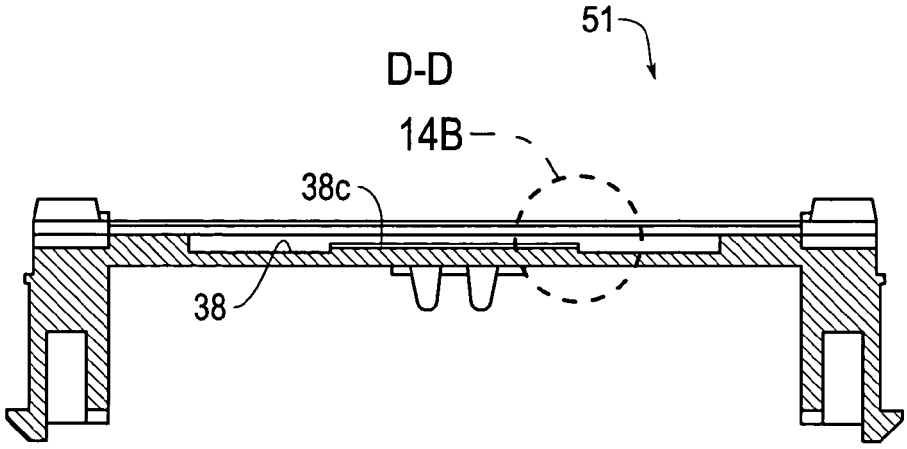
FIG. 14(*a*) is a cross-sectional view of the holder body of FIG. 12 taken at line D—D.
Figure 14B:
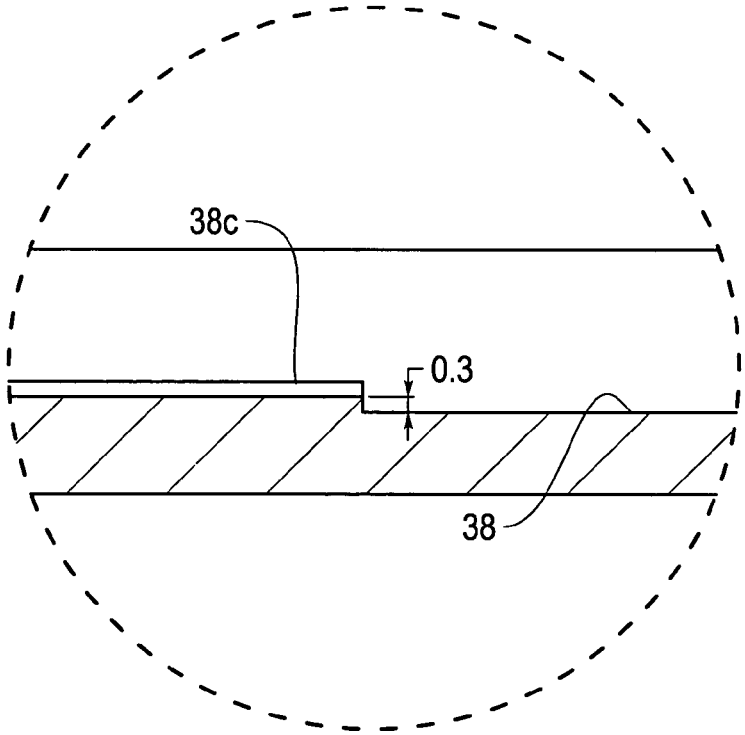

FIG. 14(*a*) shows a cross-sectional view of the holder body 51 at line D—D of FIG. 12 in a longitudinal direction including the convex portion 38*c*. FIG. 14(*b*) shows an enlarged view of the surrounding area of the convex portion 38*c* of FIG. 14(*a*). As shown in FIG. 14(*b*), the convex portion 38*c* is formed in a gap shape having an approximately 0.3 mm height with respect to the bottom surface of the concave portion 38.

The separation pad 5*a* is arranged in the region 50*b* of the concave portion 38 of the holder body 5, and the support piece 45 is arranged in the region 50*a*. The separation pad 5*a* and the support piece 45 are formed of the same material and thickness, and the film 43 is fixed under the separation pad 5*a* and also forms the low friction member 26.

Therefore, as shown in FIG. 10, the surface of the separation pad 5*a* closer to the low friction member 26 is made higher toward the sheet feeding roller 4 than the surface of other part of the separation pad 5*a* by the height of the convex portion 38*c*. Additionally, the top surface of the separation pad 5*a* is inclined by the inclined surface 38*d*, and has a convex portion 51*a* that has an inclined surface 51*b* that gradually becomes higher from the upstream side, in the feeding direction of the paper P, to the downstream side.

When the separation pad 5*a* is arranged in the holder body 51, the position of the convex portion 38*c* is pre-adjusted so as to contact the paper feeding roller 4 at the top (contact point Q of FIG. 10) of the convex portion 51*a* formed on the surface of the separation pad 5*a*. Therefore, the inclined surface 51*b* of the convex portion 51*a* is positioned on the upstream side, in the feeding direction of the paper P, with respect to the contact point Q.

When the number of sheets of paper originally stacked in the sheet feeding cassette 3 is reduced and additional paper is newly supplied in a state in which several sheets of the additional paper still remain, a coefficient of friction between the remaining paper and the newly supplied paper becomes lower than that of the originally stacked sheets of paper. As a result, the remaining paper of the original sheets and the newly supplied paper are not appropriately separated, and double-paper feeding is easily generated.

According to the second exemplary embodiment of the invention, the convex portion 51*a* is formed to reduce double-paper feeding. Therefore, as shown in FIG. 10, even if two sheets of paper P1, P2 are fed together to the vicinity of the separation pad 5*a*, before the two sheets of paper P1, P2 reach the contact point Q between the sheet feeding roller 4 and the separation pad 5*a*, in a state in which two sheets of paper are stacked together, the paper P2 positioned on the lower side contacts the inclined surface 51*b* of the convex portion 51*a* and separates from the paper P1. Thus, only the paper P1 is reliably fed to the contact point Q. Therefore, double-paper feeding can be controlled.

The convex portion 51*a*, a higher the portion of the surface of the separation pad 5*a*, is positioned upstream in the feeding direction from the contact point Q located between the separation pad 5*a* and the sheet feeding roller 4, so stacked sheets of paper P can be reliably contacted and separated at the higher portion. Additionally, the convex portion 51*a* is provided with the inclined surface 51*b*, so one sheet of paper P1 to be originally fed can be reliably guided by the inclined surface 51*b* to the contact point Q located between the separation pad 5*a* and the sheet feeding roller 4. Furthermore, the paper P2, paper other than paper P1, contacts the inclined surface 51*b* to reduce the paper P2 from being supplied to the contact point Q along with the paper P1.

When the relationship between the height of the top of the convex portion 51*a* and double-paper feeding is considered, a preferable result is obtained for double-paper feeding reduction when the height is within a range of 0.1 mm–0.3 mm. If the height is smaller than 0.1 mm, the inclination of the inclined surface 51*b* of the convex portion 51*a* is moderate, so the leading edge of the paper P2 cannot reliably contact the inclined surface 51*b*, and there is a high possibility of generating double-paper feeding.

If the height is larger than 0.3 mm, the height difference between the low friction member 26 and the convex portion 51*a* becomes large, and there is a problem that noise generation effects cannot be obtained. Furthermore, when the height of the convex portion 51*a* becomes large, the inclined angle of the inclined surface 51*b* is steep. Thus, when thick paper is fed, it is too difficult to guide the paper along the inclined surface 51*b*, and there is a problem of no-paper feeding in which paper is not transferred.

Additionally, in the second exemplary embodiment, the low friction member 26 is arranged adjacent to the separation pad 5*a*, but arrangement of the low friction member 26 is not necessarily needed. Further, it is also acceptable for only the separation pad 5*a* to be arranged in the bottom surface of the concave portion 38. In that case, the convex portion 51*a* is arranged in the vicinity of the center in the paper feeding direction of the separation pad 5*a*. Additionally, a structure can also be used in which the downstream end of the convex portion 51*a* is extended to the end portion of the separation pad 5*a*, thereby making the surface of the separation pad 5*a* higher.

Figure 15A:
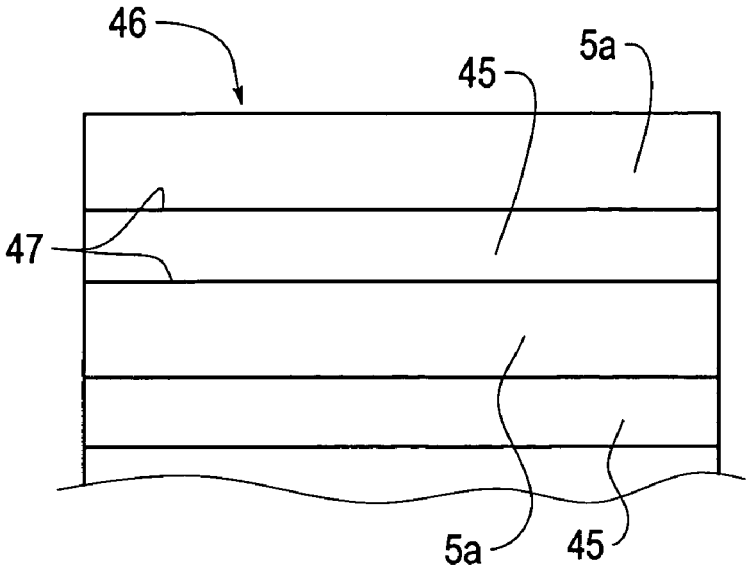
FIG. 15(*a*) is a plan view of a separation pad and a support piece.
Figure 15B:
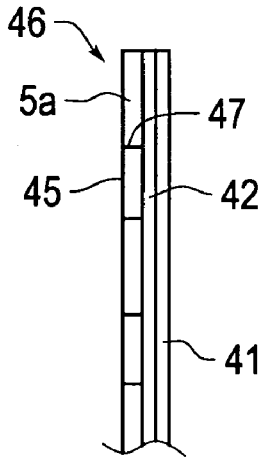

In relation to the first and second exemplary embodiments of the invention, as shown in FIGS. 15(*a*) and (*b*), it should be appreciated that a foamed urethane resin substrate 46 having a thickness of approximately 1.5 mm and a coefficient of moving friction approximately μ=0.8–1.0 may be attached to substrate 41 via a fastening member such as, for example, a double-sided adhesive tape 42 and/or the like. By inserting cutting lines 47 in the resin substrate 46 at predetermined intervals, the resin substrate 46 becomes separable into separation pads 5*a* and support pieces 45, preferably such that each adjacent pair of pieces forms a pair including a separation pad 5*a* and a support piece 45. By so doing, the thickness of the separation pad 5*a* and the thickness of the support piece 45 can be substantially matched relatively easily. Therefore, in each exemplary embodiment, the height of the gap D and the height at the top of the convex portion 51*a* can be accurately formed.

Additionally, in the first and second exemplary embodiments, it should be appreciated that the gap portion 38*a* or the convex portion 38*c* can be formed by pre-processing the bottom surface of the concave portion 38 of the holder body 5, 51 and making the region for forming the gap D or the region for forming the convex portion 51*a* higher than other regions. If the separation pad 5*a*, the support piece 45 formed by a material having the same thickness and the film 43 are arranged in the concave portion 38, the height difference according to the processing of the bottom surface can be formed at the surface of the separation pad 5*a* and the support piece 45. Therefore, compared to the case in which the bottom surface is made flat and the height difference is formed by separately adjusting the thickness of the support piece 45 and the separation pad 5*a* arranged thereon, the height difference can be easily and accurately formed.

Additionally, the means by which a desired height difference is formed on the surface of a paper pressing member, such as a low friction member 26 and a separation pad 5*a* arranged in the holder body 5, 51 is not limited to the shape or forming method of the gap D and the convex portion 51*a* in the first and second exemplary embodiments respectively. That is, this invention can be applied to the case in which an arbitrary height difference is formed in an arbitrary region of the paper pressing member.

Regarding the processing of the bottom surface of the holder body 5, 51, other than one-piece processing of the bottom surface of the holder body 5, 51 by resin molding at the time of molding the holder body, it is also acceptable to attach a separate member to the bottom surface of the holder body 5, 51 according to the desired height difference to be formed.

Additionally, it should be appreciated that instead of an automatic sheet feeding device that feeds by using a sheet feeding cassette, the sheet feeding device of this invention can also be applied to a manual paper feeding portion in which paper is inserted one by one.

According to an exemplary aspect of the invention, the surface of the low friction member is positioned closer to the roller than the surface of the separation pad by a distance of 25 μm–75 μm. This arrangement forms a gap between the sheet feeding roller and the separation pad. Therefore, when the separation pad is in a pressing state with respect to the sheet feeding roller, both noise generation and double-feeding, i.e., feeding more than one recording media at a time, can be controlled.

According to yet another exemplary aspect of the invention, the sheet feeding device is provided with the separation pad and a holder body that supports a low friction member. In the holder body, an arrangement surface is arranged so as to place the separation pad and the low friction member on adjacent portions of the arrangement surface. In the region of the arrangement surface corresponding to the low friction member, a gap formation portion is arranged so that the portion of the arrangement surface corresponding to the low frictional member is closer to the roller than a surface of the region corresponding to the separation pad.

According to this structure, if a gap formation portion is formed with respect to the portion that the low friction member on the arrangement surface of the holder body is arranged, a material is used to form the separation pad and the low friction member having the same thickness. According to the height of the gap formation portion, a gap can be formed between the surface of the separation pad and the surface of the low friction member. Compared to the case in which a gap is formed by adjusting the thickness of the separation pad and the low friction member, according to this structure, a gap can be accurately formed with a simplified structure.

According to yet another exemplary aspect of the invention, the gap formation portion is formed as one integral piece with the holder body. According to this structure, if the holder body is formed by resin molding steps of the manufacturing process can be reduced and accuracy of the gap formation portion can be stabilized, by pre-arranging the gap formation portion compared to the case of adding the gap formation portion later. As a result, the gap can be more accurately formed.

According to yet another exemplary aspect of the invention, the low friction member is formed by mounting a film, formed of a material having a small coefficient of friction, on the surface of a support piece and inserting the film under the separation pad.

According to this structure, the separation pad and the support piece are formed of the same material, and can be formed with the same thickness. By inserting the film formed of a material with a small coefficient of friction between the top surface of the support piece and the bottom surface of the separation pad, the thickness of the separation pad and the film is the same as the thickness of the low friction member, having the support piece and the film. Thus, at the time of being arranged in the holder body, a gap corresponding to the gap formation portion can be reliably formed between the top surface of the separation pad and the top surface of the low friction member.

If a low friction member is formed of a different material with a small coefficient of friction, but without the above-mentioned film, it is difficult to reliably form the separation pad and the low friction member having the same thickness.

Even if the separation pad and the low friction member can be formed with the same thickness, the materials are still different. When the separation pad and the low friction member are pressed against the sheet feeding roller, they are not necessarily reduced in a thickness direction to the same degree. Therefore, it is difficult to accurately generate a gap corresponding to the gap formation portion when they are pressed against the above-mentioned sheet feeding roller. Thus, a gap according to an exemplary aspect of this invention can be easily formed with a necessary height without encountering the above-mentioned problems.

According to yet another exemplary aspect of the invention, the sheet feeding roller is provided, at a peripheral surface, with a contact portion that contacts the recording media to feed the recording media, and a non-contact portion that does not contact the recording media to feed the recording media. The non-contact portion of the sheet feeding roller is provided with an interval holding member that contacts the recording media in a space facing the recording media and holds a predetermined interval between the separation pad and the non-contact portion of the sheet feeding roller. The gap formation portion is arranged at least at a position facing the interval holding member.

According to this structure, after the recording media is sandwiched between the contact portion of the sheet feeding roller and the separation pad and then separated, the separation pad faces the non-contact portion of the sheet feeding roller, and the interval holding member contacts the recording media therebetween. As a result, the noise that occurs after the recording media is separated is generated between the interval holding member, the separation pad, and the recording media. By arranging a gap formation portion at least at a position corresponding to the interval holding member, the surface of the low friction member facing the interval holding member can be made higher than the surface of the separation pad to control the noise generation.

According to yet another exemplary aspect of the invention, when the separation pad is pressed with respect to the sheet feeding roller, the apex of the convex portion has a height of 0.1–0.3 mm. According to this structure, double-paper feeding can be reduced.

According to yet another exemplary aspect of the invention, at least part of the convex portion is arranged upstream, in the recording media feeding direction, from the contact point of the separation pad and the sheet feeding roller. According to this structure, at least the portion in which the surface of the separation pad is made high is positioned upstream, in the recording media feeding direction, from the contact point between the separation pad and the sheet feeding roller, so recording media in a double-paper feeding state are reliably contacted and separated at the higher portion.

According to yet another aspect, the apex of the convex portion faces the vicinity of the contact point of the separation pad and the sheet feeding roller, and the convex portion has an inclined surface that gradually inclines toward the apex from the upstream side, in the feeding direction.

According to this structure, the convex portion has an inclined surface, so one sheet of recording-media that is originally fed can reach the contact point of the separation pad and the paper feeding roller by being guided to the inclined surface. The recording media, other than the originally fed recording media, can be reduced from being supplied to the above-mentioned contact point by contacting the inclined surface. When a perpendicular surface is provided from the surface of the separation pad, and toward the apex of the convex portion, there is a possibility that the one sheet of recording media that is originally fed will also contact the perpendicular surface and reduce recording medium from being fed. Therefore, with this structure, generation of such a state can be reduced.

According to yet another exemplary aspect of the invention, a holder body that supports the separation pad is provided. In the holder body, an arrangement surface is provided to arrange the separation pad. At the portion of the arrangement surface corresponding to the convex portion, a convex formation portion is arranged to make the arrangement surface at that portion higher than at other portions of the arrangement surface.

According to this structure, if the convex formation portion is arranged with respect to a portion corresponding to the convex portion of the arrangement surface of the holder body, according to the height of the convex formation portion, the surface of the separation pad can also be formed higher at the convex formation portion. Compared to the case in which the convex portion is formed by adjusting the thickness of the separation pad, the convex portion, according to this structure, can be formed with a simplified structure.

According to yet another exemplary aspect of the invention, the convex formation portion is formed as one integral piece with the holder body. According to this structure, if the holder body is formed by resin molding, steps of the manufacturing process can be reduced and accuracy of the convex formation portion can be stabilized by pre-arranging the convex formation portion, compared to the case in which the convex formation portion is fixed later. As a result, the convex portion can be more accurately formed.

According to yet another exemplary aspect of the invention, a low friction member having a surface layer, formed by a material with a coefficient of friction smaller than that of the separation pad, is arranged on the sheet feeding downstream side of the convex portion. According to this structure, in addition to the effects of reducing double-paper feeding, when the recording media sandwiched by the surface of the sheet feeding roller and the separation pad is separated and reaches a friction member with a small coefficient of friction located at the feeding downstream side adjacent to the separation pad, the frictional resistance between the friction member, and recording media is instantly reduced. As a result, the recording media is smoothly fed between the separation pad and the feeding roller surface. Therefore, paper feeding noise or the like that is generated by the recording media and the surrounding structural members can be controlled.

According to yet another exemplary aspect of the invention, when the pressing member is formed of a material having a uniform thickness and is arranged in the holder body, in order to form the height difference on the surface of the pressing member, a height difference is pre-formed between the arbitrary region and other regions of the arrangement surface of the holder body.

According to this structure, the pressing member is formed of a material with a uniform thickness, so the height difference formed on the arrangement surface becomes a height difference of the surface of the pressing member when the pressing member is arranged. As a result, a desired height difference can be easily formed on the surface of the pressing member. Furthermore, compared to the case in which the height difference is formed by adjusting the thickness of the pressing member, the height difference can be more accurately formed on the surface of the pressing member with a simplified structure.

According to yet another exemplary embodiment of the invention, the holder body is formed by resin molding. According to this structure, at the time of forming the holder body by resin molding, steps of the manufacturing process can be reduced, and accuracy of the height difference of the arrangement surface can be stabilized by pre-arranging the height difference of the arrangement surface compared to the case in which the height difference is formed later. As a result, the height difference of the surface of the pressing member can be more accurately formed.

According to yet another exemplary embodiment of the invention, a recording portion that records an image onto the recording media is provided. According to this structure, noise generated in the sheet feeding operation and double-paper feeding can be preferably reduced, and an image formation apparatus with good quality can be provided.

According to yet another exemplary embodiment of the invention, separate reproduction systems including each of exemplary embodiments of the sheet feeding device, an image forming station that forms images on the sheet, and an output device that receives the sheet from the image forming station is provided.

While this invention has been described in conjunction with the exemplary embodiments outlined above, it is evidenced that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. A sheet feeding device, comprising:

a roller that contacts and feeds recording media stacked in a sheet feeding portion;

a separation pad, having a surface with a coefficient of friction, that is pressed toward a surface of the roller; and a low friction member arranged adjacent to a feeding direction downstream side of the separation pad, the low friction member having a surface with a coefficient of friction smaller than the coefficient of friction of a surface of the separation pad, wherein the roller is arranged over the separation pad and the low friction member, and a surface of the low friction member is positioned higher than the surface of the separation pad.

2. The sheet feeding device according to claim 1, wherein the surface of the low friction member is positioned closer to the roller than the surface of the separation pad by a distance of 25 μm–75 μm.

3. The sheet feeding device according to claim 2, further comprising:

a holder body that supports the separation pad and the low friction member, the holder body having a first region in which the separation pad is arranged and a second region in which the lower friction member is arranged; and a raised portion with a surface positioned higher than a surface of the first region, the raised portion being formed in the second region.

4. The sheet feeding device according to claim 3, wherein the raised portion is formed as one integral piece with the holder body.

5. The sheet feeding device according to claim 3, wherein the low friction member is formed by mounting a film, formed of a material with a small coefficient of friction, on a support piece formed of a same material as the separation pad, and the film is inserted under the separation pad.

6. The sheet feeding device according to claim 3, wherein a surface of the roller includes a contact portion that contacts the recording media at a time of rotation and a non-contact portion that does not contact the recording media at the time of rotation.

7. The sheet feeding device according to claim 6, further comprising:

an interval holding member that contacts the recording media when the non-contact portion of the roller faces the recording media, and holds a predetermined interval between the separation pad and the non-contact portion of the sheet feeding roller, wherein the raised portion is formed in the holder body and arranged at a position facing the interval holding member.

8. A reproduction system, comprising:

the sheet feeding device of claim 1;

an image forming station that forms images on the sheet; and an output device that receives the sheet from the image forming station.

* * * * *